United States Patent [19]

Loof

[11] Patent Number: 4,966,330

[45] Date of Patent: Oct. 30, 1990

[54] APPARATUS IN A POWDER SPRAYER

[75] Inventor: Ingemar Loof, Fabriksgatan, Sweden

[73] Assignee: AC Greiff Ytbehandling AB, Nacka, Sweden

[21] Appl. No.: 424,260

[22] PCT Filed: Apr. 18, 1988

[86] PCT No.: PCT/SE88/00198

§ 371 Date: Nov. 16, 1989

§ 102(e) Date: Nov. 16, 1989

[87] PCT Pub. No.: WO88/08336

PCT Pub. Date: Nov. 3, 1988

[30] Foreign Application Priority Data

Apr. 28, 1987 [SE] Sweden ..... 871775

[51] Int. Cl.[5] ..... B05B 5/047

[52] U.S. Cl. ..... 239/690; 239/432; 239/590.5; 239/706

[58] Field of Search ..... 239/690, 692, 704, 706, 239/432, 590, 590.5; 118/629; 427/27, 181; 361/225–228

[56] References Cited

U.S. PATENT DOCUMENTS 4,359,192 11/1982 Takahashi et al. ..... 239/692
4,659,019 4/1987 Talacko ..... 239/692
4,706,890 11/1987 Talacko ..... 239/692
4,798,340 1/1989 Vohringer et al. ..... 239/692

FOREIGN PATENT DOCUMENTS 2583310 12/1986 France ..... 239/692
290271 9/1972 Sweden .

*Primary Examiner*—Andres Kashnikow
*Assistant Examiner*—Karen B. Merritt
*Attorney, Agent, or Firm*—Oblon, Spivak, McClelland, Maier & Neustadt

[57] ABSTRACT

A powder sprayer for the powder coating of an object is provided with an annular charging channel (9) for electrostatic charging of the powder. The channel is defined by an inner, longitudinal rod (8) and an outer tube, (7), both being manufactured of electrically insulating material. The rod (8) is centered in the tube (7) by means of spacer and turbulence members (10) with vanes which are obliquely inclined or helically configurated in relation to the longitudinal direction of the sprayer. In order to improve the charging and blending of the powder, the turbulators (10) are arranged pairwise after one another, each with a plurality of vanes which are distributed about the rod (8) so that through flow channels are formed between the vanes. The vanes in adjacent turbulators (10) are, in this instance, offset in the circumferential direction in relation to one another, so that the leading edges of the vanes in a downstream turbulator (10) lie in register with the through flow channels in an upstream turbulator (10).

8 Claims, 3 Drawing Sheets

APPARATUS IN A POWDER SPRAYER

TECHNICAL FIELD

The present invention relates to an apparatus in a powder sprayer which comprises an annular, friction charging channel defined by an inner longitudinal body and an outer tubular body surrounding the inner body, there being disposed, in the flow path of the powder through the sprayer, at least one turbulator with turbulence members which are obliquely inclined or are helically configurated in relation to the longitudinal direction of the sprayer.

BACKGROUND ART

In such powder sprayers—or sprayguns—as are employed for painting and lacquering work, and as utilise electrostatic charging of the powder, attempts have been made, with a view to increasing the charging degree of the powder, to realise as good a turbulence and blending of the air-powder mixture as possible in the charging channel or channels employed in the powder spraygun. One method of achieving this has been to make the configuration of the channel proper irregular, spiral or of differing cross-section, so that turbulence will thereby be created. Examples of such constructions are disclosed in Swedish Patent Applications Nos. 7206316-7 and 8007919-7.

Another prior art method of increasing the turbulence and improving the charging degree in a powder spraygun with friction charging entails that a helicoid rotational movement is imparted to the powder at the same time as the powder runs through the charging channel in the gun. One example of such a construction is described in U.S. Pat. Ser. No. 4,359,192.

In summing up the prior art technology, it might be said that, given favourable conditions, it may very well be enough to provide sufficient charging of the powder. However, if the powder is not of a uniform or homogeneous nature, but consists of mixtures of different powder varieties or qualities, the prior art constructions do not function satisfactorily. In addition, problems have arisen in certain cases, in that the powder has received an uneven charge, such that certain particles in the powder flow have been greatly charged while others have been but moderately charged or not charged at all.

OBJECTS OF THE INVENTION

The present invention has for its object to realise an apparatus of the type disclosed by way of introduction, the apparatus being designed in such a manner that it generally improves the charging degree of the sprayed powder, even if the powder is not of a unitary nature, and also under otherwise unfavourable conditions. Hence, the present invention has for its object to design the apparatus disclosed by way of introduction in such a manner that sufficient turbulence is created in the powder flow, as this runs through a friction charging channel. The invention further has for its object to realise a more even charging of the powder and to attain such a design of the spraygun that the gun may be manufactured both simply and cheaply, that parts exposed to wear may readily be replaced and that the gun may easily be cleaned.

SOLUTION

The objects forming the basis of the present invention will be achieved if the apparatus disclosed by way of introduction is characterised in that at least two turbulators are disposed in the annular channel and that turbulence members in proximally located turbulators are offset in the circumferential direction in relation to one another.

In one preferred embodiment of the apparatus according to the present invention, the turbulators are disposed in groups of two or more in mutual sequence after one another.

According to the present invention, the turbulence members are suitably also in the form of vanes projecting out from the inner body, the outer portions of the vanes abutting against the inside of the tubular body, each turbulator including a plurality of vanes uniformly distributed about the inner body such that through flow channels are formed between the vanes.

As a result of these constructional features, there will be ensured an accurate centering of the inner body in the outer body such that, thereby, the annular charging channel will have the intended configuration and size. Furthermore, the advantage will be gained according to the present invention that the turbulators may simply be manufactured in the same manner as for spirally cut gear wheels.

A further appropriate feature according to the present invention is that the cross-sectional area of a vane is less than the through flow area in a channel.

Moreover, it should also apply according to the present invention that the annular channel is of greater radial extent along those portions where the turbulators are located than along other portions of the annular channel.

Yet further advantages will be attained if the subject matter of the present invention is also given one or more of the characterising features as set forth in appended claims 6–8.

BRIEF DESCRIPTION OF THE ACCOMPANYING DRAWINGS

The nature of the present invention and its aspects will be more readily understood from the following brief description of the accompanying Drawings, and discussion relating thereto.

Figure 4:
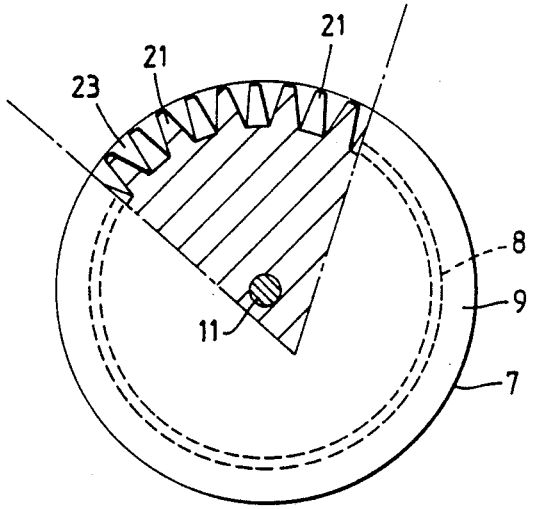
Figure 3:
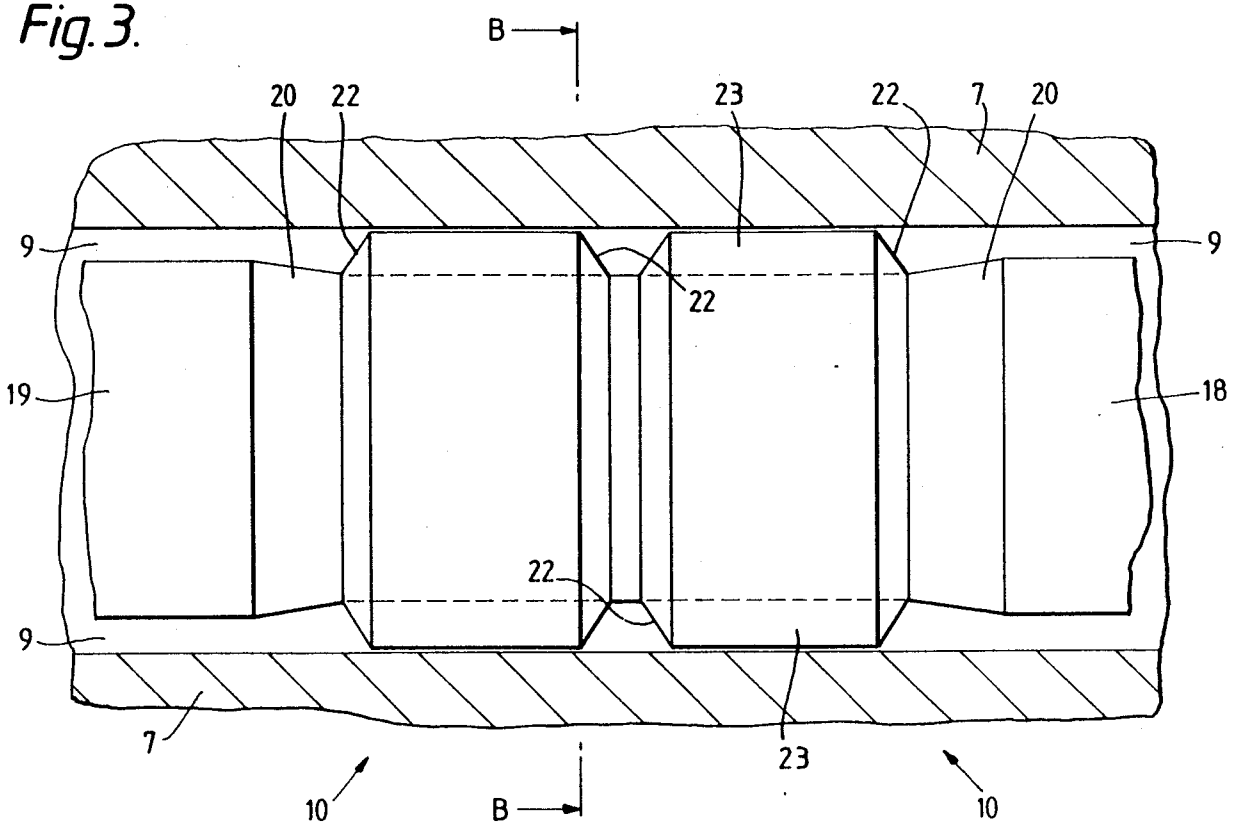

FIG. 3 schematically illustrates, on a larger scale, two mutually subsequent turbulence members according to the invention; and FIG. 4 is a section taken along the line B—B in FIG. 3.

DESCRIPTION OF PREFERRED EMBODIMENT

Figure 1:
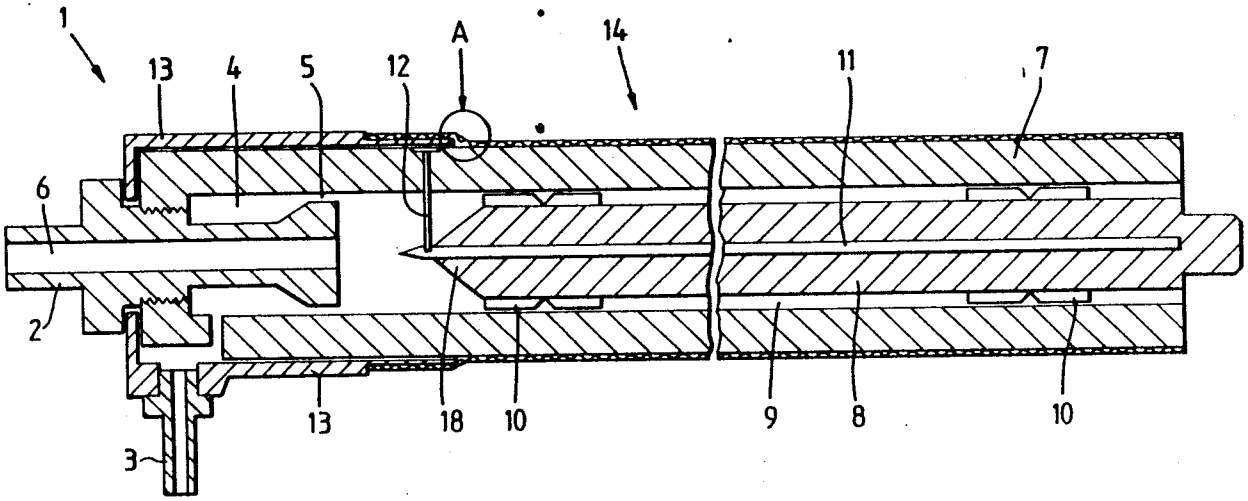
FIG. 1 is a longitudinal, approximately diametric cross-section through the subject matter of the present invention.

Referring to the Drawings, FIG. 1 shows a schematic longitudinal cross-section through the powder spraygun, the right-hand end thereof being intended for mounting of a spray nozzle which, as evenly as possible, distributes a powder-air mixture passing through the powder spraygun for charging of the powder.

In the left-hand end of the Figure, the powder spraygun has an inlet device 1 with an inlet nipple 2 for connection to a hose conduit through which a fluidised mixture of powder and air is passed. There is further provided an air inlet 3 for the regulated supply of extra air, this air being led, through a channel system, into an annular space 4 in order to flow out therefrom via an annular gap 5 and be mixed with the major flow of air and powder which is emitted centrally via the channel 6.

The powder spraygun proper consists of an outer tubular body or a tube 7 of electrically insulating material, preferably Teflon ®. Possibly, the tubular body 7 may also consist of another, for example electrically conductive material and be coated interiorly with a layer of electrically insulating material, for example Teflon ® or other suitable plastics material. Interiorly in the outer body or tube 7, there is disposed an inner rod-shaped body 8 or core which also consists of an electrically insulating material, preferably of the same material as the electrically insulating material of the outer body or tube. The inner core 8 is of slightly smaller outer diameter than the inner diameter of the outer body or tube, so that there is formed, between these two parts, a friction charging channel 9 in the form of an annular channel. The inner core 8 is centred in the tube 7 in that the inner core is provided with a number of centering members 10 which also serve as turbulators. The centering members or turbulators 10 are, therefore, shaped as screws with large pitch or as gear wheels with helically cut cogs, such that there is formed a number of channels which are helically configurated or are obliquely inclined in relation to the longitudinal direction of the gun, these channels placing the different sections of the charging channel in communication with one another. As a result, the centering members or turbulators 10 will impart rotary movement to the powder-air mixture which flows in the charging channel, so that the flow pattern will be turbulent and vortical, whereby the powder particles will come into improved contact with the channel walls.

A more detailed description of the turbulators 10 will be given below.

An inner conductor 11 of metal such as brass, copper, silver or the like is embedded or otherwise disposed interiorly in the inner body 8 or core, the conductor 11 being in the form of a longitudinal rod extending throughout substantially the entire length of the inner body 8. The end of the inner conductor facing the inlet device 1 is spiculated to a tip and is there in electric contact with contact springs 12 which are preferably manufactured of metal. The contact springs 12 are anchored in and extend through the outer tube 7 and are, on the outside thereof, in electric communication with a hood 13 which is manufactured of metal and surrounds the inlet device 1 and a portion of the outer tube 7. The hood 13 and the inner conductor 11 will hereby be in electric contact with one another.

Figure 2:
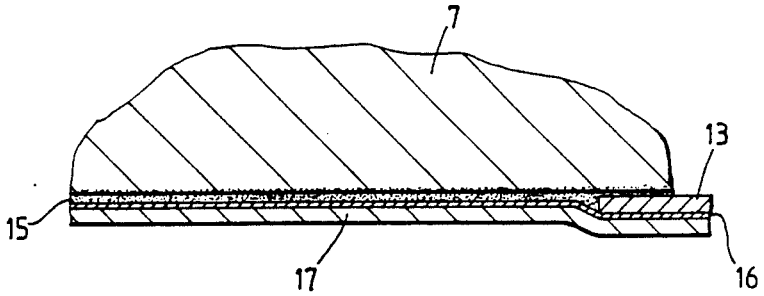
FIG. 2 is a part magnification of the area ringed A in FIG 1.

On the outside of the outer tube 7, there is disposed an outer electric conductor 14 whose detailed construction is more readily apparent from FIG. 2. The outer conductor 14 is electrically well-connected to the hood 13, is tubular and extends along substantially the entire outer surface of the tube 7. Hereby, the outer conductor 14 will surround the annular charging channel 9 substantially throughout its entire length. Correspondingly, the annular charging channel will surround the inner conductor 11, also throughout substantially the entire length of the annular charging channel.

FIG. 2 shows a large-scale magnification of the ringed portion of FIG. 1 marked A. It will be apparent from FIG. 2 that the hood 13 connects to the outer tube 7 as closely as is practically feasible. Furthermore, there is disposed on the outer surface of the tube 7 a layer 15 of a pulverulent electric conductor such as graphite, metal particles, carbon particles or the like. Outside the conductive pulverulent layer 15, there is disposed a metal foil, metal tube, metal mesh or some similar powerfully electrically conductive material which may be of a relatively weak material, so that it is readily deformable but nevertheless sufficiently robust to provide a good electric conductive capacity. In the illustrated embodiment, use is made of a metal foil which has reference numeral 16 and connects to the outside of the hood 13. On the outside of the metal foil 16, there is provided a shrink-on hose of plastics material which is shrunk on about the metal foil, the hood 13 and the pulverulent conductive layer 15. As a result of the relatively large shrink-on force of the shrink-on hose 17, an extremely intimate contact will be established between the pulverulent layer 15 and the outer tube 7, which, in the Figure, is intimated in that the pulverulent layer 15 is partly shown as embedded in the outer peripheral surface of the tube 7. In the same manner, there will be established, as a result of the effect of the shrink-on hose, good electric contact between the pulverulent layer 15 and the superjacent metal foil 16. Naturally, good electric contact will also be ensured between the metal foil 16 and the hood 13.

As was intimated above, the outer tube 7 need not be a thick-walled tube of plastics material. Instead, the outer tube may be a metal tube which is provided with an interior lining of the relevant plastics material. Hereby, the pulverulent layer 15 and the metal foil 16 could be dispensed with, if the outer metal tube is electrically connected to the hood 13 or its counterpart, and, in addition, to the inner conductor 11.

While not being apparent from the Drawing, the hood 13 is suitably provided with an electric connection terminal so that the inner and outer conductors may have the same potential and, moreover, a potential which is linked to earth or to the object which is to be sprayed.

As was briefly mentioned above, the purpose of the turbulators 10 is partly to realise the favourable turbulence in the powder-air mixture as it passes through the charging channel 9, and partly to centre the inner body or core 8 with the inner conductor 11. For practical reasons, the outer tube or body 7 should be interiorly cylindrical, whereby all turbulators 10 may be of the same dimensions.

For manufacturing reasons, the inner core 8 is suitably divided into a number of sections in mutual sequence and produced as separated parts. These parts are then joined together in that they are provided with a central bore for accommodating the inner conductor 11 which, in its turn, holds together the whole of the inner core 8 by means of a thread connection or other suitable provision.

According to the present invention, the turbulators are arranged in groups of two and two, or more, in mutual sequence. A plurality of such groups may be disposed along the inner body or core 8 and, in one practical embodiment, three groups each of two turbulators have proved suitable. The first group of turbulators 10 (most proximal the inlet device 1) is disposed immediately adjacent an inlet cone 18 to the charging channel 9. This inlet cone 18 may, in a practical design, be provided with an inner thread which cooperates with a mating thread on the inner conductor 11 so that, thereby, the inlet cone 18 may function as a nut which unites the whole of the inner body or core 8.

At its major end, the the inlet cone 18 is of slightly smaller diameter than the major portion of the inner body or core 8, so that, thereby, the charging channel 9 will have a slightly larger radial extent immediately ahead of the first turbulator 10. Correspondingly, the charging channel is of slightly greater radial depth immediately after the turbulators. This feature is achieved in that the parts 19, in addition to the turbulators 10 and the inlet cone 18, of which the inner core 8 is composed, are provided with conical or tapering portions 20 whose smallest diameter approximately corresponds to the diameter of the major end of the inlet cone 18.

Each turbulator 10 includes a number of turbulence members 21 which are in the form of vanes projecting out from the inner core 8 and are uniformly distributed about the inner core so that there are formed, between adjacent vanes, through flow channels 23 which guide the powder flow into a vortical flow pattern. The radially outer portions of the vanes are formed to follow the contour of the inner surface of the tubular body 7, and the longitudinal direction of the vanes is obliquely inclined, or makes an angle with, the longitudinal direction of the charging channel 9. Furthermore, the vanes 21 may be either approximately straight or arched such that the pitch of the vanes will either be constant throughout the entire length, or increase or decrease along this length.

In order that the flow resistance through the turbulators is not excessively great, it is appropriate that the end surfaces 22 of the vanes (as is apparent from FIG. 3) make an angle with a diametric plane to the inner core 8 such that, thereby, the leading and trailing surfaces of the turbulators 10 in the flow direction will be approximately conical. Furthermore, the end surfaces 22 should be rounded or spiculated.

According to the invention, the through flow channels located between the vanes 21 should have larger cross-sectional areas than is the case for the material cross-section in the vanes. Furthermore, the vanes are suitably slightly broader at their root portions than at their outer portions. The total of the through flow areas in each turbulator should approximately correspond to the through flow area in the charging channel 9, which has been realised in that the channels in the turbulators are of greater radial extent than is the case for the annular charging channel 9.

It will also be apparent from FIG. 3 that the turbulators 10 disposed in groups of two have therebetween a short gap so that there is formed an annular space between proximally located end surfaces 22. Furthermore, the turbulence members or vanes 21 are offset in the circumferential direction on proximally located turbulators, whereby, for example, the end surfaces 22 will be located in register with the through flow channels 23 on the adjacent turbulator. Naturally, other mutual offset relationships may also be employed, even though the above-mentioned configuration has proved to be the most efficient for its purpose.

Since the sole purpose of the through flow channels 23 is to create turbulence, and a possible helical flow pattern in the charging channel 9, the through flow channels 23—and consequently also the vanes 21—need not be of excessively great axial length. Practical experiments have shown that a length along the longitudinal direction of the charging channel 9 of roughly the same order of magnitude as the inner diameter of the outer body 7 is suitable. Furthermore, experiments have demonstrated that an angle of pitch, i.e. the angle between the longitudinal direction of the vane 21 and a plane at right angles to the longitudinal direction of the charging channel 9 of approximately 45° for the vanes 21 is suitable, even though other angles of pitch—appropriately in the range of between 30 ° and 60°—may also be employed.

If different angles of pitch for the vanes 21 are relevant, the selection of angles of pitch should suitably be placed in relationship to the axial flow rate in the annular charging channel such that a high axial flow rate requires a greater angle of pitch for the vanes, and vice versa.

While not being apparent from the Drawings, the pitch for all of the turbulators faces in the same direction, so that, thereby, the flow through the annular charging channel will follow a helical course with rotation in the same direction throughout the entire length of the channel 9. However, it is naturally conceivable to switch the direction of pitch of the turbulators so that the rotation will be counter-directed along different portions of the annular charging channel 9.

In order to adapt the turbulators to the flow pattern which prevails at each respective turbulator, it is also possible to provide a large pitch for those turbulators which lie most proximal the inlet device (where the flow is substantially axial) and then gradually reduce the pitch the further away from the inlet device the turbulator in question is located (where the flow already rotates). Hereby, the pitch which the rotating flow experiences in the channel 9 could become approximately constant for all turbulators.

The present invention should not be considered as restricted to that described above and shown on the Drawings, many modifications being conceivable without departing from the spirit and scope of the appended claims.

What is claimed is:

1. An apparatus in a powder sprayer comprising an annular friction charging channel (9) defined by an inner, longitudinal body (8) and an outer, tubular body (7) surrounding the inner body, there being disposed, in the flow path of the powder through the sprayer, at least one turbulator (10) with turbulence members (21) which are obliquely inclined or helically configurated in relation to the longitudinal direction of the sprayer said turbulence members being shaped as substantially radially extending vanes spaced along the circumference of the annular channel, characterised in that at least two turbulators (10) are disposed in the annular channel (9); and that the annular channel (9) has a bigger radial extent immediately upstream and downstream of a turbulator (10) and within the area of the turbulator than is the case at remaining portions of the annular channel.

2. The apparatus as claimed in claim 1, characterised in that the size of the through flow area of the annular channel (9) approximately coincides with the size of the through flow area of flow channels (23) through the turbulators (10).

3. The apparatus as claimed in claim 1 or 2, characterised in that, the turbulence members (21) of adjacent turbulators (10) are distributed about the longitudinal body (8) such that the turbulence members (21) of a downstream turbulator are aligned with the flow channels (23) between adjacent turbulence members (21) of an upstream turbulator.

4. The apparatus as claimed in claim 1 or 2, characterised in that the turbulators (10) are disposed in groups of two or more in mutual sequence after one another.

5. The apparatus as claimed in claim 1 or 2, characterised in that, the radially outermost portions of the turbulence members (21) abutt the inner surface of turbular body (7) to thereby center the inner body (8).

6. The apparatus as claimed in claim 2, characterised in that the cross-sectional area of one vane (21) is less than the through flow area in one channel (23).

7. The apparatus as claimed in claim 1 or 2, characterised in that the turbulence members (21) or the vanes, respectively, have an angle of pitch in relation to a plane at right angles to the longitudinal direction of the charging channel (9) in the range of between 30° and 60°.

8. The apparatus as claimed in claim 1 or 2, characterised in that the axial length of each turbulator (10) approximately corresponds to the inner diameter of the tubular body (7).

* * * * *

UNITED STATES PATENT AND TRADEMARK OFFICE

CERTIFICATE OF CORRECTION

PATENT NO. : 4,966,330

DATED : October 30, 1990

INVENTOR(S) : Ingemar Loof

It is certified that error appears in the above-identified patent and that said Letters Patent is hereby corrected as shown below:

On the title page, in item [30]:

The Foreign Application Priority Data is incorrect, should be, --April 28, 1987 [SE] Sweden.....8701775.

Signed and Sealed this

Twentieth Day of October, 1992

*Attest:*

DOUGLAS B. COMER

*Attesting Officer*

*Acting Commissioner of Patents and Trademarks*